United States Patent [19]

Riethmann

[11] Patent Number: 4,623,385

[45] Date of Patent: Nov. 18, 1986

[54] METHOD OF AND APPARATUS FOR INTRODUCING ADDITIVES INTO A METAL BATH

[75] Inventor: Max Riethmann, Ermatingen, Switzerland

[73] Assignee: Georg Fischer Aktiengesellschaft, Schaffhausen, Switzerland

[21] Appl. No.: 761,607

[22] Filed: Aug. 1, 1985

[30] Foreign Application Priority Data

Aug. 8, 1984 [CH] Switzerland ..... 03804/84

[51] Int. Cl.[4] ..... C21C 7/02

[52] U.S. Cl. ..... 75/53; 75/58

[58] Field of Search ..... 75/53, 58, 130 R

[56] References Cited

U.S. PATENT DOCUMENTS

| | | | |
|---|---|---|---|
| 2,803,533 | 8/1957 | Bieniosk | 75/53 |
| 2,805,147 | 9/1957 | Schreiber | 75/53 |
| 2,806,781 | 9/1957 | Shepherd | 75/53 |
| 3,514,285 | 5/1970 | Bakkerns | 75/53 |
| 3,955,966 | 5/1976 | Meichsner | 75/53 |

*Primary Examiner*—Peter D. Rosenberg

*Attorney, Agent, or Firm*—Toren, McGeady, Stanger, Goldberg & Kiel

[57] ABSTRACT

For introducing additives, such as inoculating agents, into a metal bath, the additive is held in a supply container. A slide device carries measured amounts of the additive from the supply container to an immersion pipe extending downwardly into a metal bath located in a vessel. A flow of gas is provided into the immersion pipe adjacent the point where the additive is introduced into the pipe. The gas carries the additive downwardly through the immersion pipe for mixture into the metal bath. The additive can be supplied continuously or in intermittent portions to the immersion pipe. The additive is introduced below the surface of the metal bath in accurately measured amounts in a safe reproducible manner.

5 Claims, 2 Drawing Figures

METHOD OF AND APPARATUS FOR INTRODUCING ADDITIVES INTO A METAL BATH

BACKGROUND OF THE INVENTION

The present invention is directed to a method of and apparatus for introducing additives, in particular inoculation agents, into a metal bath.

It is known to introduce additives into a metal bath, either for the purpose of degasification, deoxidation, desulfurization, or alloying of the metal melt. Further, it is known to introduce the additives in powder form, granulated or in large pieces into the metal melt by hand or mechanically. In addition, it has been proposed to introduce the additives by means of a lance using gases as the conveying medium. These various ways of introducing additives are not fully reliable. Particularly, the manual introduction of the additives is often difficult and depends to a great degree on the ability of the person effecting the introduction.

Supplying the additives into the metal bath by means of a lance can be disadvantageous, since frequently the lance is destroyed by the bath. Furthermore, the use of lances is restricted primarily to batch treatments. Additive introduction by a lance generally causes violent turbulence within the metal bath. Such turbulence is especially undesirable when the melt contains easily oxidizable additives, such as magnesium.

SUMMARY OF THE INVENTION

Therefore, it is the primary object of the present invention to provide a method of and an apparatus for introducing additives into a metal bath so that advantages are achieved with regard to operation, delivery, reproducibility, and economy. The disadvantages listed above in known methods and apparatus can be avoided.

In accordance with the present invention, a measured amount of an additive is conveyed from a supply container to an immersion pipe by a slide member. Gas is directed into the immersion pipe so that it carries the additive downwardly through the pipe for introduction into the bath below its surface.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
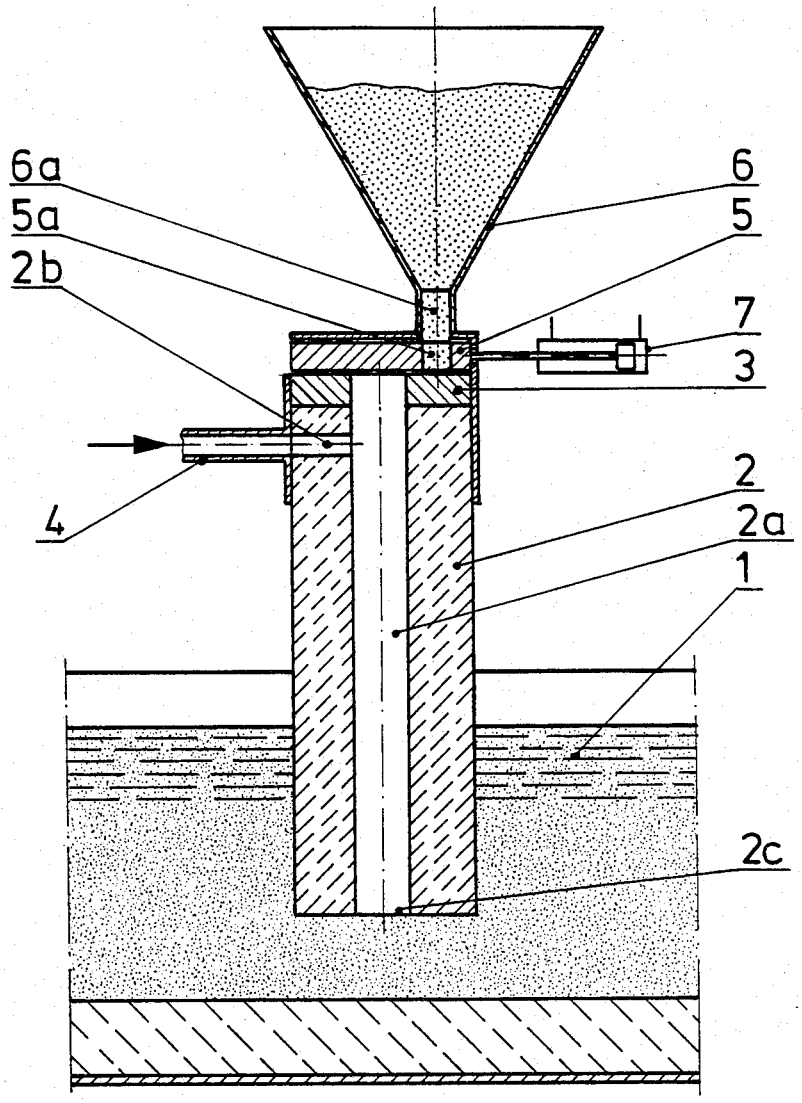
FIG. 1 is a schematic sectional view of an apparatus embodying the present invention.

In FIG. 1 a metal bath 1 is shown within a vessel with an immersion pipe 2 extending downwardly into the metal bath. The upper end of the immersion pipe is spaced upwardly from the metal bath while its lower end is located below the surface of the bath. Immersion pipe 2 has a vertically arranged passage 2*a* extending between its upper end and lower end. Adjacent the upper end of the immersion pipe 2 spaced upwardly from the metal bath 1, a bore 2*b* extends transversely of the passage 2*a* into the passage. On the exterior of the pipe 2 the bore 2*b* is connected to a line 4 which leads to a pressure source, not shown. Immersion pipe 2 has an upper pipe end 3 forming a continuation of the passage 2*a*. A slide device 5 is mounted on the upper side of the pipe end 3 and a displacement member 7 is attached to the slide device. The slide device 5 has a chamber or passage 5*a* extending downwardly through it and, as shown in FIG. 1, the chamber is in alignment with the outlet 6*a* of a supply container 6 for an additive. By actuating the displacement element 7, the slide device 5 can be moved so that the passage 5*a* is aligned with the passage 2*a* in the immersion pipe.

The procedure for introducing additives, such as inoculation agents, into the metal bath is as follows.

The additive or inoculation agent contained within the passage 5*a* in the slide device 5 is moved over the passage 2*a* so that the additive drops downwardly into the passage 2*a*. As a result, measured portions of the inoculation agent are removed from the supply container 6 and introduced into the immersion pipe. A gas is directed through the line 4 and the bore 2*b* into the upper end of the passage 2*a* in the immersion pipe 2. When the gas emerges from the lower end 2*c* of the immersion pipe, the inoculation agent is entrained within and comes into contact with the melt. The lower end 2*c* of the immersion pipe 2 is located below the level of the surface of the bath so that the innoculation agent is dissolved in the bath and does not form slag on the surface of the bath. Preferably, a non-oxidizing gas is used.

It is preferable to use a slide plate with different sized chambers as the slide device 5. Accordingly, different chamber or passage 5*a* volumes can be provided. For the continuous supply of the inoculating agent, a rotary slide plate could be employed with uniformed sized chambers. As shown in FIG. 1, the slide device 5 is reciprocated by the displacing element 7 so that the passage or chamber 5*a* is filled when it aligns with the outlet 6*a* from the supply container 6 and then discharges the inoculation agent when the slide device is moved with the chamber or passage aligned with the passage 2*a* in the immersion pipe. To prevent the melt from rising in the pipe, the immersion pipe is always maintained under a constant pressure.

Figure 2:
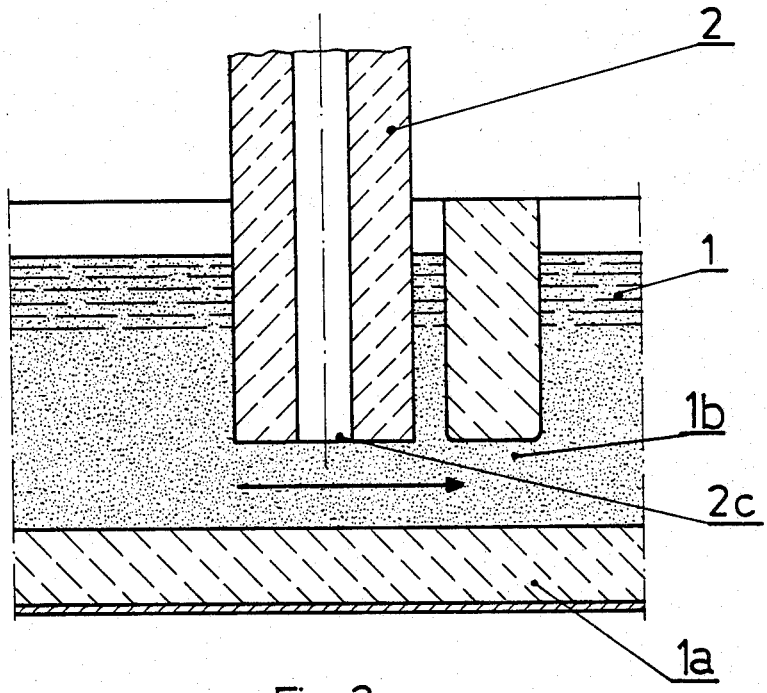
FIG. 2 is another emboidment of the apparatus shown in FIG. 1.

The described apparatus can be arranged as shown in FIG. 2 in a metal transport channel in the metal bath, preferably at a location where the flow path 1*b* is narrowed. With this arrangement an increased flow speed is provided for the distribution of the inoculation agent into the metal bath. As can be seen in FIG. 2, the lower end of the immersion pipe 2 is located adjacent to and upstream from the narrowed flow path 1*b*.

While specific embodiments of the invention have been shown and described in detail to illustrate the application of the inventive principles, it will be understood that the invention may be embodied otherwise without departing from such principles.

I claim:

1. Apparatus for introducing additives, such as inoculating agents, into a metal bath, comprising a vessel forming the metal bath, a generally vertically arranged immersion pipe having a first end and a second end with the first end submerged in the metal bath in said vessel, said immersion pipe extending upwardly out of the metal bath with the second end of said immersion pipe spaced upwardly from the surface of the metal bath in said vessel, a supply container for the additive located above the metal bath in said vessel, said container having an outlet for discharging additive downwardly therefrom, said outlet being offset laterally from the second end of said immersion pipe, slide means forming a chamber displaceable between alignment with the outlet of said supply container and alignment with the second end of said immersion pipe so that a quantity of the additive can be removed from the supply container into the chamber in the slide means and with the chamber of the slide means moved into alignment with the immersion pipe the introduction of the additive can be effected downwardly through the immersion pipe into the metal bath.

2. Apparatus, as set forth in claim 1, wherein said immersion pipe has a passageway extending between the first and second ends thereof, a bore extending through said immersion pipe adjacent the second end thereof and transversely of the direction between the first and second ends with said bore opening into said passage for supplying a gas thereto.

3. Apparatus, as set forth in claim 2, wherein said gas is a non-oxidizing gas.

4. Apparatus, as set forth in claim 1, wherein said slide means comprises a slide plate having a plurality of chambers therein with said chambers defining different volumes.

5. Method, as set forth in claim 1, including the step of maintaining a pressure within said immersion pipe for preventing the metal bath from rising in the immersion pipe.

* * * * *